US006915580B2

(12) United States Patent
Dassel

(10) Patent No.: US 6,915,580 B2
(45) Date of Patent: Jul. 12, 2005

(54) EXTENDABLE RAZOR HANDLE ASSEMBLY

(76) Inventor: Lisa L. Dassel, 3007 W. Delaware, City of Evansville, Vanderburgh County, IN (US) 47701

( * ) Notice: Subject to any disclaimer, the term of this patent is extended or adjusted under 35 U.S.C. 154(b) by 17 days.

(21) Appl. No.: 10/679,048

(22) Filed: Oct. 3, 2003

(65) Prior Publication Data

US 2004/0068879 A1 Apr. 15, 2004

Related U.S. Application Data

(60) Provisional application No. 60/415,610, filed on Oct. 3, 2002.

(51) Int. Cl.[7] ..... B26B 21/52

(52) U.S. Cl. ..... 30/526; 30/537; 30/340

(58) Field of Search ..... 30/526–534, 340, 30/232, 537

(56) References Cited

U.S. PATENT DOCUMENTS 4,905,372 A * 3/1990 Willis ..... 30/526
5,373,643 A * 12/1994 Warren ..... 30/322
5,704,127 A * 1/1998 Cordio ..... 30/49

* cited by examiner

*Primary Examiner*—Douglas D Watts
(74) *Attorney, Agent, or Firm*—Gary K. Price, Esq.

(57) ABSTRACT

A razor handle assembly having a telescoping extension body portion with a loop-handle at one end and a gripping portion at the opposite end, the gripping portion is detachably connected to the handle of a typical shaving razor.

10 Claims, 2 Drawing Sheets

EXTENDABLE RAZOR HANDLE ASSEMBLY

CROSS REFERENCES TO RELATED APPLICATIONS

None

Statement as to rights to inventions made under Federally sponsored research and development: U.S. Provisional Application for patent 60/415,610, filed Oct. 3, 2002, with title "Extendable Razor Handle Assembly" which is hereby incorporated by reference. Applicant claims priority pursuant to 35 U.S.C. Par. 119(e)(I).

BACKGROUND OF THE INVENTION

1. Field of the Invention

The present invention relates generally to a razor for shaving and more particularly, to a razor having a telescopically extending handle for increasing the reach of the user of the razor.

2. Brief Description of Prior Art

Shaving razors are commonly used by consumers for shaving various body parts such as faces, and legs. Conventional shaving razors have the disadvantage of being limited in their overall reach due to the fact that the length of the handle of the typical razor is designed to only fit within the palm of the user's hand, such that the razor head is close to the user's hand. As a result, using such razors to reach remote locations of the body, such as the lower portions of the legs, can require much effort and discomfort. This is especially the case when the user has a physical disability, is overweight, or is pregnant.

Extendable handles have been developed that extend the overall reach of the razor in order to help facilitate the shaving procedure.

U.S. Pat. No. 4,905,372, to Willis, discloses a razor handle extension. Willis' handle extension is designed with a clamping head that will accommodate various razor handle types. The clamping head of Willis does not provide a positive lock between razor handle and handle extension, thus allowing the shaving razor to shift position in relation to the longitudinal axes of the handle extension, increasing the difficulty of grooming hard to reach areas of the body.

U.S. Pat. No. 5,167,069, to Quinn discloses a telescopically extendable and retractable body having a manual handle at one end and a pivoting razor shaving assembly at the opposite end. While the device disclosed by Quinn has the advantage of extending the reach of the user, the handle is capable of extending to merely two positions, and therefore is limited in its ability to accommodate the reach of various users, as well as its ability to reach a variety of different bodily surfaces.

What is needed to overcome this problem is a razor shaving assembly having a telescopically extendable body that is extendable to varying distance. Such an assembly would enable a user to selectively extend the reach of the shaving blade significantly beyond the reach of their hands.

As will be seen from the subsequent description, the preferred embodiments of the present invention overcome shortcomings of the prior art.

SUMMARY OF THE INVENTION

The present invention relates generally to an extendable razor handle assembly having a telescopically extending handle for increasing the reach of the user of the razor. The razor system generally includes a loop-handle portion, an extension body portion, and a shaver gripping portion which is detachably connected to a handle of a typical shaving razor. The extension body portion comprises an extending segment having a diameter smaller than the diameter of the extension body portion. The extension body portion and the segment having a bore extending axially therethrough so that the extension body portion telescopically receives the smaller extending segment. When the telescoping segment is fully extended, a spring clip disposed in the extension body portion engages one of a series of notches provided in the end of the segment so as to hold the segment in a variety of adjustable lengths. Attached to the outermost end of the segment, opposite the said notches, and extending from the extension body portion is said gripping portion. Said loop portion is disposed at the end of the extension body portion opposite the gripping portion.

The handle portion of the shaving razor is attached to the gripping portion by a locking member. The gripping portion further includes a head-end having at least a pair of outwardly extending gripping fingers around a hollow interior, said fingers being formed by evenly spaced axially extending slots. Said locking sleeve slides over the fingers. Rotating a tapered screw connector in a clockwise direction will cause the locking sleeve in contact with fingers causing said gripping fingers to press inwardly.

DESCRIPTION OF THE PREFERRED EMBODIMENT

Figure 1:
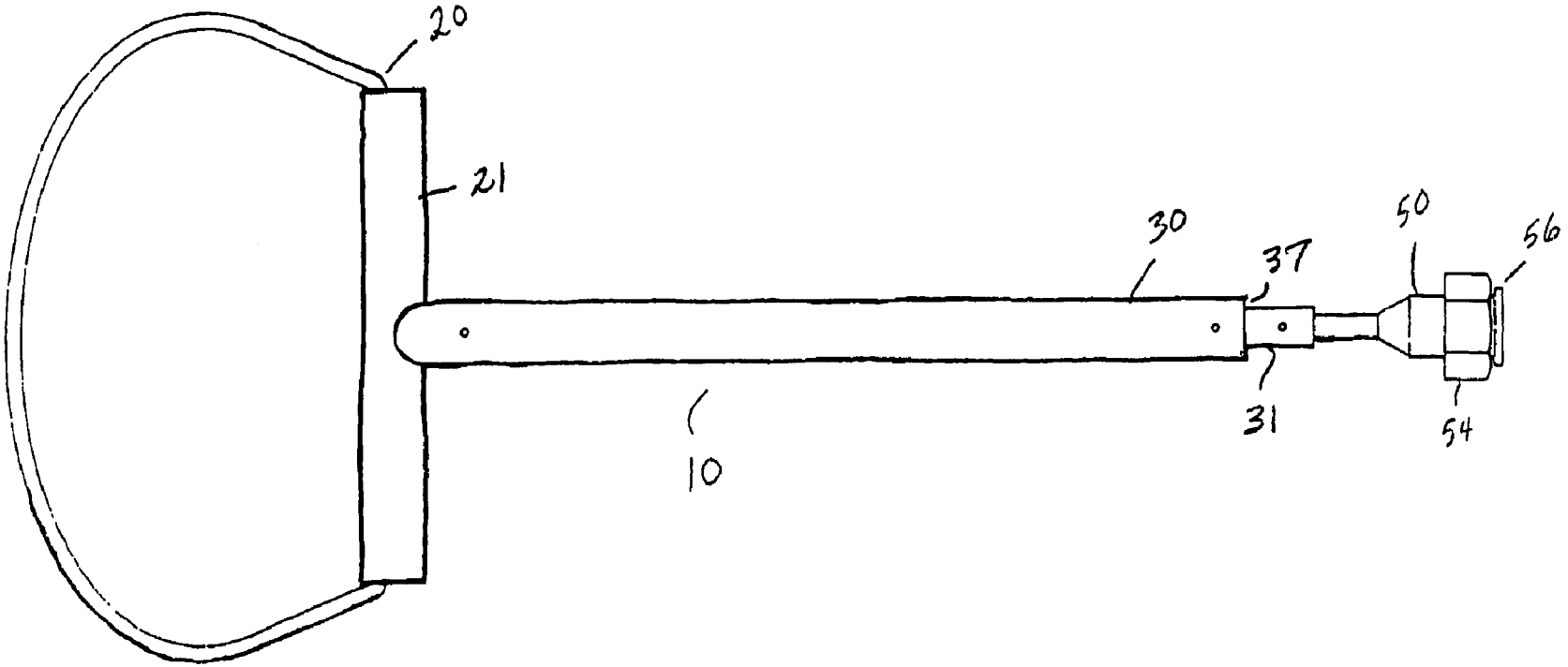
FIG. 1 is a side view of a preferred embodiment of the present invention, an extendable razor handle assembly.
Figure 2:
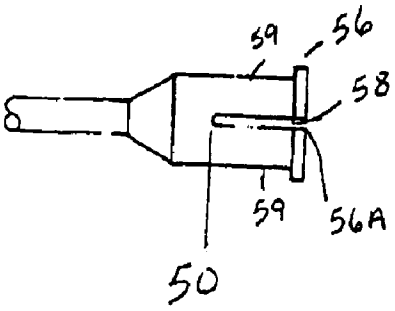
FIG. 2 is an enlarged detail of the head portion of the extendable razor handle assembly of FIG. 1.
Figure 3:
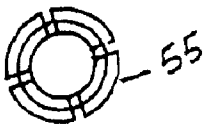
FIG. 3 is a front view of a locking ring of the extendable razor handle assembly of FIG. 1.
Figure 4:
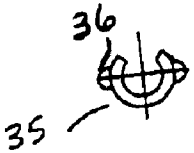
FIG. 4 is a front view of a spring clip of the extendable razor handle assembly of FIG. 1.

FIGS. 1–4 illustrate a preferred embodiment of an extendable razor handle assembly 10 made in accordance with the present invention. The razor handle assembly 10 provides a lightweight, easily constructed apparatus designed to extend the handle of a typical shaving razor to various lengths to enable the user to extend the reach of a shaving blade significantly beyond the reach of the hands. That is, and as will be described, the handle of a shaving razor may be removably retained by the razor handle assembly 10. In this manner, the length of the assembly 10 is effectively increased so that a user may more easily and safely shave the selected body portion while in a generally standing or seated position thereby avoiding the discomfort of having to bend over.

Specifically, it will be noted in the drawings that the razor handle assembly 10 relates to a telescoping extension assembly interconnecting the assembly 10 and the handle of a typical shaving razor. In the broadest context, the assembly 10 consists of components configured and correlated with respect to each other so as to attain the desired objective.

Referring to FIG. 1, the razor handle assembly 10 generally includes a loop-handle 20, an extension body portion 30, and a razor gripping portion 50 which is detachably connected to a shaving razor (not shown).

The extension body portion 30 includes an extending segment 31. The extension body portion 30 and the segment 31 having a bore extending axially therethrough so that the larger diameter extension body portion 30 telescopically receives the smaller diameter extending segment. As such, the segment 31 is telescopically interconnected with the extension body portion 30, so as to receivingly engage one another. The outer wall of the segment 31 frictionally and slidingly engages the inner wall of the extension body portion 30 such as known in the art of telescoping devices such as antennas. When the telescoping segment 31 is fully extended, a spring clip 35 (shown in FIG. 4) is provided in the extension body portion 30 that engages one of a series of notches (not shown) provided in the end of the segment 31 so as to prevent the segment 31 from being removed completely from the larger extension body portion 30 as is well known in telescopic antennas. Friction between segment 31 and extension body portion 30 can hold the segment 31 in a virtually limitless number of extended positions. Spring clip 35 clips around the diameter of segment 31 near the end held in body portion 30, the raised areas 36 engage a reduced diameter section 37 of the body portion 30 to prevent the segment 31 from coming completely out of body portion 30.

As a result of the configuration as described above, it is understood that the segment 31 can be adjusted to a virtually infinite number of positions, thereby allowing the extension body portion 30 to provide a virtually limitless number of extension positions. As shown in FIG. 1, the extension body portion 30 in its most compact position, may receive nearly the entire length of the telescoping segment 31 within the bore, such that only the gripping portion 50 and a short length of the segment 31 protrudes from the extension body portion 30. However, it is understood that the extension body portion 30 may likewise receive only a portion of the segment 31 thereby extending the assembly 10 to its extended adjustment without departing from the scope of the invention.

The extension body portion 30 may comprise a variety of materials known in the art, such as metal, plastic, or fiberglass for example. The extending segment 31 of the extension body portion 30 is preferably flexible so that the blade portion of the typical shaving razor conforms closely to the contours of the body portion being shaved. Preferably, the segment 31 is made of a flexible, resilient, rust-resistant metallic material such as an aluminum composite. When the shaving operations are completed, the extension body portion 30 receives the segment 31 in a compact position as described above, and the segment 31 retains its substantially straight shape due to the flexible resiliency of the segment 31.

Attached to one end of the extension body portion 30 and specifically to the outermost end of the segment 31 is said gripping portion 50. The loop-handle 20 is disposed at the end of the extension body portion 30 opposite the gripping portion 50. The loop-handle 20 is appropriately connected to the extension body portion 30 so that the assembly 10 may be hung at a convenient location. The loop-handle 20 is large enough to grip and can include a "T" portion 21 to further enhance the ergonomic aspect of the assembly for an elderly person that may have trouble gripping.

The gripping portion 50 interconnects the razor handle assembly 10 to the handle of the typical shaving razor (not shown). The gripping portion 50 is detachably engaged with the handle of the shaving razor. The handle portion of the shaving razor (not shown) is attached to the gripping portion 50 by a locking member 55, such as a locking ring shown in FIG. 3. Accordingly, when it is desired to remove or replace the shaving razor from the assembly 10, the shaving razor is removed from the gripping portion 50 by unlocking the locking ring 55.

The gripping portion 50 further includes a head-end 56 having a plurality of outwardly extending gripping fingers 59 around a hollow interior 56A. The fingers 59 being formed by evenly spaced axially extending slots 58. The locking sleeve 55 slides over the fingers 59. As will be described, rotating a screw connector 54 in a clockwise direction will cause the locking sleeve 55 in contact with fingers 59 causing said gripping fingers 59 to press inwardly. Thus, the gripping portion 50 holds the razor in a compression grip.

In operation, the locking ring 55 is located around the outermost end of the gripping portion 50. The handle of the shaving razor is detachably connected to the gripping portion 50 by rotating the screw connector 54 into releasable engagement with the gripping portion 50 as previously described. The handle of the shaving razor is then inserted into the hollow interior 56A of the head-end 56 of the gripping portion 50. With the razor portion of the shaving razor extending outwardly from the gripping portion 50, the screw connector 54 is rotated in the clockwise direction causing the locking ring 55 to move up along gripping portion 50. The movement of locking ring 55 along the head-end 56 causes the fingers 59 to project inward and into engagement with the handle of the razor. The locking ring 55 is seated on the gripping portion 50 so as to firmly anchor the handle of the shaving razor at the hollow interior 56A of the head-end 56 and between the fingers 59. Accordingly, an extendable razor handle assembly 10 is provided permitting the user to shave various hard to reach body areas comfortably and safely. By rotating the screw connector 54 in a counter clockwise direction, fingers 59 are allowed to outwardly rotate from the handle of the shaving razor thereby releasing the handle from the assembly 10. Segment 31 can be collapsed telescopically into extension body portion 30 and the assembly 10 can be hung up by loop-handle 20 with or without the razor in the gripping portion 50.

Although the description above contains many specificities, these should not be construed as limiting the scope of the invention but as merely providing illustrations of some of the presently preferred embodiments of this invention.

Thus the scope of the invention should be determined by the appended claims in the formal application and their legal equivalents, rather than by the examples given.

I claim:

1. An extendable assembly to extend a handle of a razor to various lengths, said extendable assembly comprising:

an extension body portion, a loop-handle attached to one end of the extension body portion and a razor gripping portion attached to the opposite end of the extension body portion, wherein the extension body portion includes an extended segment telescopically interconnected with the extension body portion, wherein the razor gripping portion has a plurality of gripping fingers that releasably engage the handle of the shaving razor, a threaded locking ring to drive said gripping fingers into engagement with said loop-handle.

2. The extendable assembly as recited in claim 1, wherein said extending segment frictionally engages said extension body portion such that once a length of said extendable assembly is telescopically set said extending segment is frictionally held to maintain the length.

3. The extendable assembly as recited in claim 2, including a "T" portion in said loop-handle to aide in gripping the extendable assembly.

4. An extendable handle assembly to extend a razor to various lengths, said extendable assembly comprising:

an extension body portion, a handle attached to one end of the extension body portion and a razor gripping portion attached to an opposite end of the extension body portion, wherein the extension body portion includes an extended segment telescopically interconnected with the extension body portion and, wherein the razor gripping portion has a threaded compression grip that releasably engages the shaving razor, wherein said handle includes a "T" shaped portion attached to said one end of the extension body portion.

5. The extendable handle assembly as recited in claim 4, wherein the "T" shaped portion forms part of a loop.

6. The extendable handle assembly as recited in claim 5, wherein said extended segment frictionally engages said extension portion such that said extendable handle assembly can be extended to a length and the length will be held by said frictional engagement.

7. The extendable handle assembly as recited in claim 6, wherein the length can be chosen from any length ranging from a fully collapsed length to a fully extended length of said extended segment relative to said extension body portion.

8. The extendable assembly as recited in claim 7, wherein said razor gripping portion includes a threaded locking ring to drive gripping fingers into engagement with said razor.

9. An extendable handle razor comprising:

en extension body portion, a handle attached to one end of the extension body portion and a razor gripping portion attached to an opposite end of the extension body portion, wherein the extension body portion includes an extended segment telescopically interconnected and frictionally engagable with the extension body portion and, wherein the razor gripping portion has a compression grip that releasably engages the shaving razor, wherein said handle includes "T" shaped portion attached to said one end of the extension body portion, wherein the "T" shaped portion forms part of a loop.

10. The extendable handle assembly as recited in claim 9, wherein said extended segment frictionally engages said extension portion such that said extendable handle assembly can be extended to any length and a length once set will be held by said frictional engagement between said extended segment and said extension body portion.

* * * * *